US005486911A

United States Patent [19]

Rubscha et al.

[11] Patent Number: 5,486,911

[45] Date of Patent: Jan. 23, 1996

[54] DOCUMENT HANDLER FOR IMAGING SYSTEM WITH PLURAL MODE OUTPUT TRAY

[75] Inventors: Robert F. Rubscha, Fairport; Margaret C. Tsai, Rochester, both of N.Y.

[73] Assignee: Xerox Corporation, Stamford, Conn.

[21] Appl. No.: 352,017

[22] Filed: Dec. 8, 1994

[51] Int. Cl.[6] ..... G03G 21/00; B65H 31/04

[52] U.S. Cl. ..... 355/329; 271/213

[58] Field of Search ..... 355/318, 319, 355/320, 321; 271/213, 220

[56] References Cited

U.S. PATENT DOCUMENTS

| | | | |
|---|---|---|---|
| 4,218,128 | 8/1980 | Satomi et al. | 355/319 X |
| 4,375,326 | 3/1983 | Lang | 355/319 |
| 4,459,013 | 7/1984 | Hamlin et al. | 271/220 |
| 4,916,493 | 4/1990 | DeVito | 355/321 |
| 5,014,976 | 5/1991 | Muck et al. | 271/220 |
| 5,339,139 | 8/1994 | Fullerton et al. | 355/215 |

*Primary Examiner*—Fred L. Braun

[57] ABSTRACT

In a document handling system for feeding either simplex or duplex document sheets to be imaged at an imaging station, and for restacking the simplex or duplex document sheets in proper collated order in a single output stacking tray; including a reversible exit nip for the reversal of a duplex document sheet in the exit nip while extending therefrom before returning the duplex document sheet to the imaging station for the imaging of its second side, or for document sheet ejection and stacking into the output stacking tray from the exit nip without reversal; a pivotable mounting system is provided for the output stacking tray. One end of the tray is automatically pivotable from a position substantially below the reversible exit nip to a raised position above the reversible exit nip to provide an unobstructed duplex document sheet reversing space under the output stacking tray in its raised position. The document handling system includes duplex documents exit path system for inverting and transporting the duplex document sheets to the opposite end of the stacking tray after the imaging of their second sides.

3 Claims, 1 Drawing Sheet

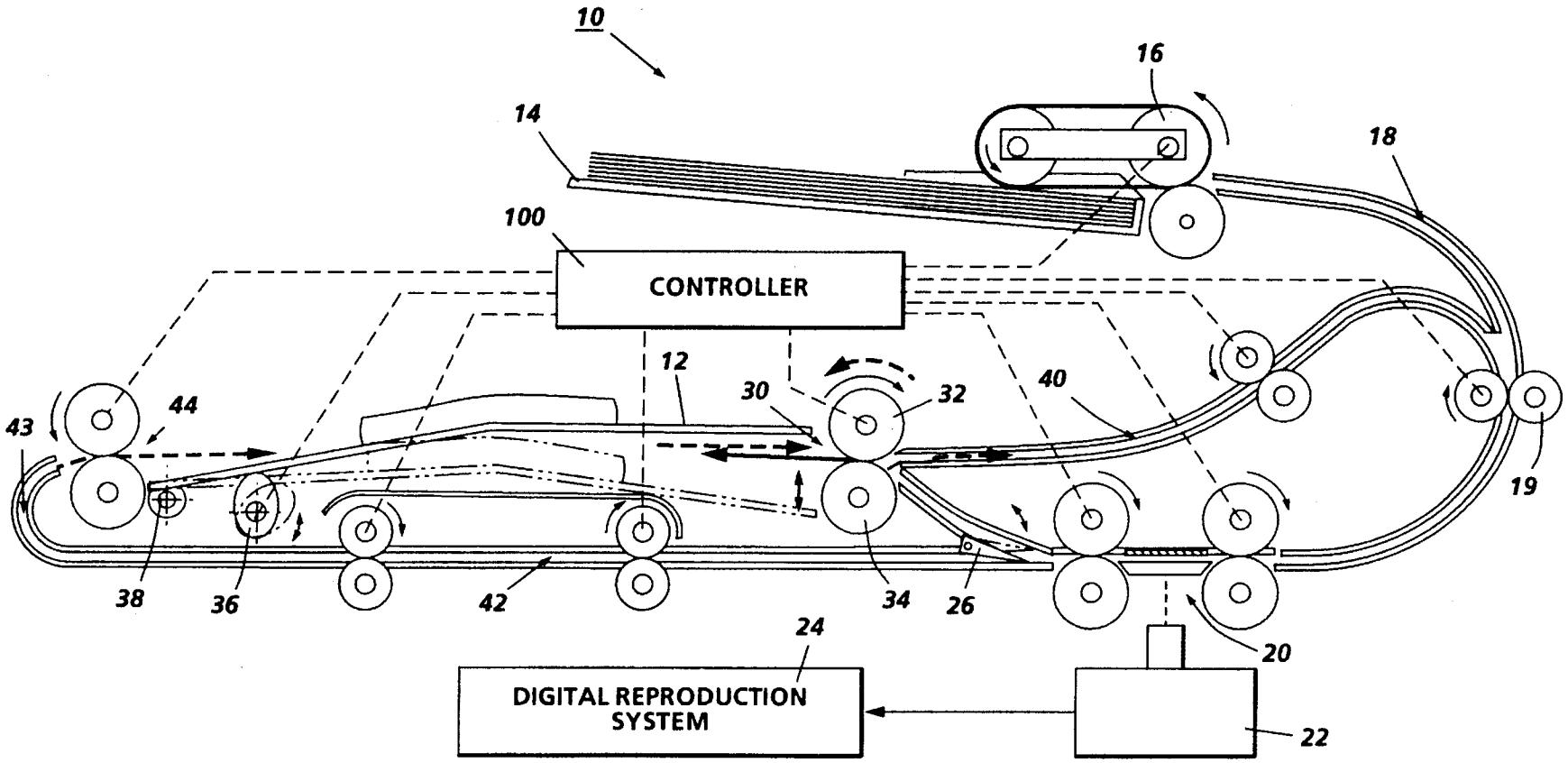
CONTROLLER
DIGITAL REPRODUCTION SYSTEM
10
12
14
16
18
19
20
22
24
26
30
32
34
36
38
40
42
43
44
100

DOCUMENT HANDLER FOR IMAGING SYSTEM WITH PLURAL MODE OUTPUT TRAY

Disclosed is an improved document handler for an imaging system for handling both simplex and duplex originals for imaging in a compact manner, with increased efficiency and improved duplex document inversion and document stacking of both the simplex and duplex documents in proper collated order in the same output tray.

More specifically, there is disclosed in the embodiment herein a document handler with a plural mode output tray which is designed to have at least one end of the tray pivot below a sheet entrance path thereto for sheet stacking, and to pivot above said sheet entrance for providing an unobstructed inversion chute under the tray for the reversal of duplex sheets being inverted.

The embodiment disclosed herein solves problems previously experienced with reversing exit nip sheet reversal duplexing systems, as described in the below-cited patents, including accidentally dragging a previously stacked sheet back into the nip of the exit rollers with the sheet being reversed.

The basic concept of using a reversing exit nip for duplex documents being inverted in an imaging system document feeder is more fully disclosed (and discussed with reference to additional prior art) in issued Xerox Corporation U.S. Pat. No. 5,339,139, issued Aug. 16, 1994 to Jack K. Fullerton, et al. The system disclosed herein is proposed as an improvement over said U.S. Pat. No. 5,339,139, incorporated by reference herein. Said U.S. Pat. No. 5,339,139 also provides further descriptions of other features of document handlers, and additional descriptions for components of the example disclosed herein.

Further descriptions of document reversing exit roller problems and an alternative solution therefor in a generally similar document handler are described in recently copending commonly assigned Xerox Corporation U.S. application Ser. No. 08/332,289 filed Oct. 31, 1994, by this same Margaret C. Plain, Attorney Docket No. D/94492.

Other examples of a reversing exit nip, for the inversion of duplexed copy sheets in a duplexing copy sheet path system, are disclosed in Xerox Corporation U.S. Pat. Nos. 4,916,493 and 5,014,976.

The disclosed document handling embodiment is shown for a digital imaging system, as in said U.S. Pat. No. 5,339,139. However, it will be appreciated that such document handlers and/or the platens on which they may be mounted are alternatively useful for light-lens copying systems, as noted for example in Xerox Corporation U.S. Pat. No. 5,078,379, Col. 3, para. 3 (D/88274C), and other references cited in said U.S. Pat. No. 5,339,139.

An additional feature of the disclosed embodiment herein is the entrance of the restacking duplexed documents from the opposite end of the exit, output, or restacking tray from which the simplex documents are fed in to be restacked in that same tray. That feature per se is shown in Xerox Corporation U.S. Pat. No. 4,459,013 issued Jul. 10, 1984 to Thomas J. Hamlin and Clifford L. George, in another simplex and duplex document handling system for a reproduction apparatus. Also, in commonly assigned allowed U.S. App. Ser. No. 08/167,304 by Thomas Acquaviva, (D/91723) filed Dec. 16, 1993, to become U.S. Pat. No. 5,392,109. However, in the exemplary system disclosed herein, this feature is compatibly provided in combination with a plural mode pivoting output tray system which provides the additional function of providing an unobstructed reversal of the duplex sheet being inverted in a manner in which the operator is not exposed there to the sheet nor is the sheet being reversed in contact with any sheets previously stacked in the tray. As an optional feature, the same pivoting tray may also be optionally used to provide restacking at different stacking angles, if desired, for varying sheet energy due to exiting sheet velocity.

A specific feature of the specific embodiment disclosed herein is to provide a document handling system for feeding either simplex or duplex document sheets to be imaged at an imaging station, and for restacking the simplex or duplex document sheets in proper collated order in a single output stacking tray; including a reversible exit nip for the reversal of a duplex document sheet in said exit nip while extending therefrom before returning said duplex document sheet to said imaging station for the imaging of its second side, and for document sheet ejection and stacking into said output stacking tray from said exit nip without reversal; comprising a pivotable mounting system for said output stacking tray so that one end of said output stacking tray is pivotable from a position substantially below said reversible exit nip to a raised position above said reversible exit nip; an unobstructed duplex document sheet reversing space under said output stacking tray in said raised position of said output stacking tray above said reversible exit nip; and a control system for automatically pivoting said output stacking tray to said raised position above said exit nip for said reversal of said duplex document sheet in said reversible exit nip, so that said extension of said duplex document sheet from said exit nip occurs underneath said output stacking tray in said unobstructed duplex document sheet reversing space, said control system automatically pivoting said output stacking tray down to said position substantially below said exit nip for said ejection and stacking of document sheets in said output stacking tray from said exit nip.

Further specific features provided by the system disclosed herein, individually or in combination, include those wherein said exit nip ejects only simplex documents into said output stacking tray; further including a duplex documents exit path system for inverting and transporting said duplex document sheets to the opposite end of said stacking tray after said imaging of said second sides of said duplex documents, and ejecting said duplex documents into said output stacking tray from said opposite end thereof; and/or wherein said duplex documents exit path system includes a natural inversion path portion.

By way of further general background, as xerographic, digital, and other copiers, facsimile systems and/or printers increase in speed, and become more automatic, it is increasingly important to provide higher throughput-yet more reliable and more automatic handling of document sheets being copied. Yet, with this and other sheet stack feeding, it is very desirable to provide a compact, light weight, small footprint document handler, with minimal misfeeding, document jamming, or document damage. Original document handling, particularly for delicate, valuable, thick or irregular documents, is often more difficult and critical than feeding blank or virgin copy sheets, particularly for documents with typing, smearable ink, fuser oil or other materials thereon susceptible of smearing or contamination of other documents by the sheet separation and feeding process.

The disclosed apparatus may be readily operated and controlled in a conventional manner with conventional document handler and reproduction apparatus control systems, including sheet detecting switches, sensors, etc. It is well known and preferable to program and execute such control functions and logic with conventional software instructions for conventional microprocessors. This is taught by various patents and commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being imaged or copied. A "simplex" document is one having its image on only one side or face of the sheet, whereas a "duplex" document normally has images on both sides.

In the description herein the term "sheet" refers to a usually flimsy sheet of paper, plastic, or other such conventional individual image substrate. The "copy sheet" may be abbreviated as the "copy". A "job" is a set of related sheets, usually a collated copy set copied from a set of original document sheets or electronic page images from a particular user or otherwise related.

As to specific hardware components of the subject apparatus, or alternatives therefor, it will be appreciated that, as is normally the case, some such hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of an embodiment thereof, including the drawing figure (approximately to scale) wherein:

FIG. 1 (the Figure) is a partly schematic, partly cross-sectional side view of one example of the subject document handling system in which one example of the subject pivoting exit tray thereof is illustrated in its raised solid line position for duplex sheet inversion reversal thereunder, and is illustrated in phantom for its alternative sheet output stacking position.

Turning now to the exemplary document handler 10 shown in FIG. 1 (the Figure), as previously noted, various known details thereof need not be described in detail, and are available, for example, from said above-cited U.S. Pat. No. 5,339,139, etc. The above-cited patents also discuss the difficulties in reversing a duplex sheet over a stack of previously ejected sheets. The previously ejected sheets may interfere with the reversing sheet, particularly if they have edge curl. Furthermore, a previously ejected top sheet may be inadvertently pulled back into the exit rolls nip with the reversing sheet. Said above-cited patents discuss this problem and provide mechanical separating devices at the exit roll nip area to solve this problem.

It may be seen that the system disclosed herein completely avoids this problem by pivoting the exit tray 12 entrance end above the exit nip 30 for and during reversing duplex documents. This positively ensures that the tray 12 is interposed between all the previously stacked sheets and the reversing sheet. Thus, with the present system, there is no possibility of any contact between the sheet being reversed in the exit roll nip 30 and any previously ejected sheet. Furthermore, the exit tray 12 here provides an overlying protective enclosure of the sheet being reversed so that there is no possibility of the operator's hand being engaged by a moving sheet edge during its reversing operation, or vice versa.

Briefly now describing the sheet feeding paths of the exemplary document handler 10 to the pivoting exit or output tray 12, it will be appreciated that this is merely one example, and that many other document paths and alternatives can be provided. In the example here, the sheets are loaded into a top input tray 14 face up in regular 1 to N order and fed out by a top feeder 16 into an initial common arcuate natural inverting path 18. All of the document paths here may be conventionally provided by conventional baffles and feed rolls, or the like. Here the initial path 18 leads to initial or take away rollers 19 feeding the document sheets on to a conventional two roll constant velocity transport (CVT) imaging station 20, through a common simplex and duplex document path thereto, which path, together with the initial path 18, provides one complete inversion of the document before it reaches the imaging station 20. At the imaging station 20 the constantly moving document may be scanned by a stationary digital scanning system 22, which may be of a known type as described in said previously cited and other patents. E.g., an array of multiple photosensors and an illumination system extending across or transverse to the document path. This digital scanner 22 is, of course, conventionally connected to a digital reproduction system 24, which may be a local and/or remote (network connected) digital printer and/or facsimile system, or the like.

Just downstream of the imaging station 20 there is a gate 26 in the document path. When the gate 26 is down (in its solid position, as shown) it deflects the moving sheets up into a document path extending into an exit nip 30 defined by sets of mating exit rollers 32, 34. The gate 26 is held in said position for deflecting sheets directly from the imaging station 22 to the exit nip 30 for ejection and stacking in tray 12 where the sheets are simplex document sheets which need to be copied on only their one imaged side.

The pivoting of the exit tray 12 between its two illustrated operative positions (intermediate positions may also be provided for varying stack heights) is in this example provided by rotation thereagainst by a cam 36 actuated by an available clutch from the drives for the sheet path rollers, or from a solenoid, or any other suitable drive system. Numerous other tray pivoting arrangements may be readily envisioned.

The exit tray 12 here is pivoted at its downstream, left, or duplex stacking end about a pivot 38 adjacent that end. Thus, it is primarily the opposite, upstream, or simplex end of the tray 12 which pivots here. As shown, this end pivoting is a substantially vertical movement above and below the exit nip 30. The tray 12 simplex end is thereby pivoted well below the exit nip 30 for stacking of simplex sheets in the tray 12 after they have been copied or imaged at the imaging station 20, as described above.

Turning now to the mode or situation in which the document sheets in the input tray 14 are duplex documents, these may be fed to the imaging station 20 sequentially in the same manner as described above for simplex documents, for copying of the first side of the duplex documents. Likewise, after the copying of the first side of a duplex document, the gate 26 is also in its lowered position to deflect the duplex documents into the exit rollers 32, 34, exit nip 30.

However, for duplex documents, as shown here by the dashed line reversing arrow in the exit nip 30, the rollers 32, 24 and thus the duplex documents therein are reversed after the duplex document is almost through the exit nip 30. During this partial feed in and then reversal of the duplex document in the exit nip 30, the tray 12 is pivoted up (into its illustrated solid line position) completely above the exit nip 30, so that the duplex sheet is fed into the space under the tray 12, completely unobstructed and with no possibility of any contact with any of the sheets which may have been previously stacked in the tray 12.

The reversed duplex document is fed back into a duplex return path 40 (as shown by the further dashed line arrow therein) which returns the now reversed duplex document sheet back into the feed rollers 19, and thus back to the imaging station 20, with another inversion, for copying of the second side of the duplex document in the imaging station 20.

However, at this point, before the lead edge of the duplex document copied on its second side reaches the gate 26, the gate 26 is now lifted. Thus, in the particular system illustrated herein, the duplex document is now fed into a duplex exit path 42 running underneath the exit tray 12. The duplex exit path 42 has a natural inversion portion 43 at the end thereof beyond the end of the tray 12 which inverts the duplex document and brings it up into a separate duplex exit nip 44 defined by exit rollers at that (opposite) end of the tray 12.

In this manner, duplex documents may be immediately restacked in proper collated order into the same tray 12, but from the opposite end as is used for simplex documents, without requiring a separate tray for duplex documents, and without requiring a third and non-copying circulation of the duplexed documents simply to invert the documents before restacking. This latter avoids a final skipped pitch for duplex documents as compared to, for example, one system described in the cited U.S. Pat. No. 5,339,139.

The controller 100 will know where the position of sheets are in the document path and thus know when to operate the gate 26, the reversible exit rollers 32, and the cam 36 for the tray 12, etc., in a conventional manner from conventional software programming of the microprocessor, as is well known in the art. The controller 100 also knows whether the sheet is a simplex or duplex sheet. As is well known, this information is typically programmed in by the operator pressing a button or touch screen display on the user interface of the reproduction apparatus or document handler at the time the particular documents are loaded into the input tray 14. Alternatively, it is known that a low resolution scanner may be provided on the duplex or second side of the document path 18 as the documents are initially fed into the system, to look for any second side image on the document and thereby automatically determine if the document is a duplex document. This is known for example from Xerox Corporation U.S. Pat. No. 4,248,528 to Sahay, issued Feb. 3, 1981.

An additional feature which can be provided is to provide molded in or otherwise integral guide baffles on or under the bottom of the exit tray 12 to assist in the above described reversal thereunder of duplex documents in the reversible exit nip 30. A fixed sheet guide baffle may also be provided between the bottom of the tray 12 and the underlying duplex exit path 42, as shown. However, neither is essential. The duplex sheet reversal incurs with the exit tray lifted well above the reversing sheet, so that there can be no interaction with previously ejected sheets in the tray, and there is a clear and unobstructed path and space for inverting the duplex sheet.

Although the separate duplex exit path 42 and exit nip 44 here provide the advantages noted, it will be appreciated that they can be eliminated and the duplex documents may also be stacked into the tray 12 from the upstream end thereof with the tray 12 in its lowered or phantom position after the second sides of the duplex documents have been copied. In that case, an additional (second) sheet reversal in the nip 30 (with the tray 12 raised) is first provided, and the duplex document is again fed back through the path 40 and rollers 19 and scanning station 20 (but without copying) and lowered gate 26 back again to the exit roller 30, and in the meantime the tray 12 is lowered to receive the ejection of this now properly inverted duplexed document into the tray 12. In either case, the documents will be restacked in the tray 12 in the same 1 to N or first to last collated order as the originals were stacked in the input tray 14.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a document handling system for feeding either simplex or duplex document sheets to be imaged at an imaging station, and for restacking the simplex or duplex document sheets in proper collated order in a single output stacking tray; including a reversible exit nip for the reversal of a duplex document sheet in said exit nip while extending therefrom before returning said duplex document sheet to said imaging station for the imaging of its second side, and for document sheet ejection and stacking into said output stacking tray from said exit nip without reversal, the improvement comprising:

a pivotable mounting system for said output stacking tray so that one end of said output stacking tray is pivotable from a position substantially below said reversible exit nip to a raised position above said reversible exit nip;

an unobstructed duplex document sheet reversing space under said output stacking tray in said raised position of said output stacking tray above said reversible exit nip; and a control system for automatically pivoting said output stacking tray to said raised position above said exit nip for said reversal of said duplex document sheet in said reversible exit nip, so that said extension of said duplex document sheet from said exit nip occurs underneath said output stacking tray in said unobstructed duplex document sheet reversing space, said control system automatically pivoting said output stacking tray down to said position substantially below said exit nip for said ejection and stacking of document sheets in said output stacking tray from said exit nip.

2. The document handling system of claim 1, wherein said exit nip ejects only simplex documents into said output stacking tray; further including a duplex documents exit path system for inverting and transporting said duplex document sheets to the opposite end of said stacking tray after said imaging of said second sides of said duplex documents, and ejecting said duplex documents into said output stacking tray from said opposite end thereof.

3. The document handling system of claim 2, wherein said duplex documents exit path system includes a natural inversion path portion.

* * * * *